US006062745A

United States Patent [19]

Rosenburgh et al.

[11] Patent Number: 6,062,745

[45] Date of Patent: May 16, 2000

[54] METHOD AND APPARATUS FOR CONDITIONING PREVIOUSLY DEVELOPED FILMSTRIP

[75] Inventors: John H. Rosenburgh, Hilton; David L. Patton, Webster; Ralph L. Piccinino, Jr., Rush, all of N.Y.

[73] Assignee: Eastman Kodak Company, Rochester, N.Y.

[21] Appl. No.: 09/141,715

[22] Filed: Aug. 28, 1998

[51] Int. Cl.[7] ..... G03D 3/08; G03D 13/00

[52] U.S. Cl. ..... 396/564; 355/27; 396/615

[58] Field of Search ..... 396/612, 617, 396/620, 622, 626, 627, 615, 564; 355/27–29; 134/64 P, 64 R, 122 P, 122 R; 15/100

[56] References Cited

U.S. PATENT DOCUMENTS

| | | | |
|---|---|---|---|
| 2,967,119 | 1/1961 | Gutterman | 134/64 R |
| 3,737,941 | 6/1973 | Miller et al. | 15/100 |
| 4,126,391 | 11/1978 | Nishimoto | 355/27 |
| 4,294,533 | 10/1981 | Bratt et al. | 396/627 |
| 4,362,376 | 12/1982 | Otani | 396/615 |
| 4,719,483 | 1/1988 | Yamazaki | 396/594 |
| 5,325,144 | 6/1994 | Yoshikawa et al. | 396/612 |
| 5,327,189 | 7/1994 | Wernicke et al. | 396/615 |

*Primary Examiner*—D. Rutledge
*Attorney, Agent, or Firm*—Frank Pincelli

[57] ABSTRACT

A method and apparatus for conditioning a previously developed photosensitive material. The method includes subjecting the photosensitive material to a liquid bath prior to scanning or printing the photosensitive material and the apparatus includes a second processing path for subjecting the previously developed photosensitive material to only some of the processing baths used for processing an undeveloped exposed photosensitive material.

22 Claims, 4 Drawing Sheets

METHOD AND APPARATUS FOR CONDITIONING PREVIOUSLY DEVELOPED FILMSTRIP

FIELD OF THE INVENTION

The present invention relates to a method and apparatus for reconditioning a photosensitive material prior to printing and/or scanning thereof.

BACKGROUND OF THE INVENTION

In a typical photographic processing lab a majority of the processing is directed to exposed undeveloped film, typically in the form of a strip. The undeveloped exposed film is first passed through a film processor and then is either scanned and/or printed shortly thereafter. Since the filmstrip has just recently passed through a film processor where it is washed and dried, there is substantially little or no contaminates or artifacts present on the film during scanning or printing. The photographic lab also receives orders from customers for reprinting of images on previously developed film. However, when previously developed films are received from customers, the films have often been stored such that various contaminates or artifacts are present on the film which can substantially affect the quality of the printing or scanning. For example, fingerprints, smudges, dust, and other substances deposited onto the film negative should be removed prior to reprinting or scanning. In addition, film negatives that have been stored may have excessive warpage or curl due to the expansion/contraction of the emulsion layers relative to the base material. This warpage can adversely affect image focus during the scanning or printing operation.

The act of having an individual personally clean or recondition a filmstrip negative can add substantial material and labor expense to the reprinting process.

Thus, there is a need to provide a method and apparatus for reconditioning of a film previously developed having contaminates and/or which is warped prior to reprinting and/or scanning in a cost-effective manner.

SUMMARY OF THE INVENTION

The present invention is directed to overcoming one or more of the problems set forth above. Briefly summarized according to one aspect of the present invention, there is provided a method for conditioning a previously developed photosensitive material, comprising the steps of:

a) subjecting the photosensitive material to a liquid bath; and b) scanning the photosensitive material shortly after passing the photosensitive material through the liquid bath so as to obtain a digital record of the images on the photosensitive material.

In accordance with another aspect of the present invention there is provided a method for reconditioning a photosensitive material comprising the steps of:

a) subjecting the photosensitive material to a liquid bath; and b) passing the photosensitive material through a printer shortly thereafter so as to expose the images on the photosensitive material onto a photosensitive material.

In accordance with yet another aspect of the present invention there is provided an apparatus for developing images on a photographic material and for conditioning of a previously developed photosensitive material, the apparatus comprising:

a plurality of chemical baths for developing an exposed, undeveloped photosensitive material;

a first processing path passing through the chemical baths for developing the exposed, undeveloped photosensitive material; and a second processing path passing through at least one of the chemical baths for conditioning means of previously developed photosensitive material.

In yet another aspect of the present invention, there is provided a method of conditioning previously exposed, undeveloped photosensitive material and an apparatus having a plurality of chemical baths for developing an exposed, undeveloped photosensitive material, a first processing path through the chemical baths for developing the exposed, undeveloped photosensitive material, and a second processing path through at least one of the chemical baths for conditioning the previously developed photosensitive material, the method comprising the step of passing the previously exposed, undeveloped photosensitive material through the second processing path.

The above, and other objects, advantages and novel features of the present invention will become more apparent from the accompanying detailed description thereof when considered in conjunction with the following drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

The present description will be directed in particular to elements forming part of, or in cooperation more directly with, the apparatus in accordance with the present invention. It is understood that elements not specifically shown or described may take various forms well known to those skilled in the art.

Figure 1A:
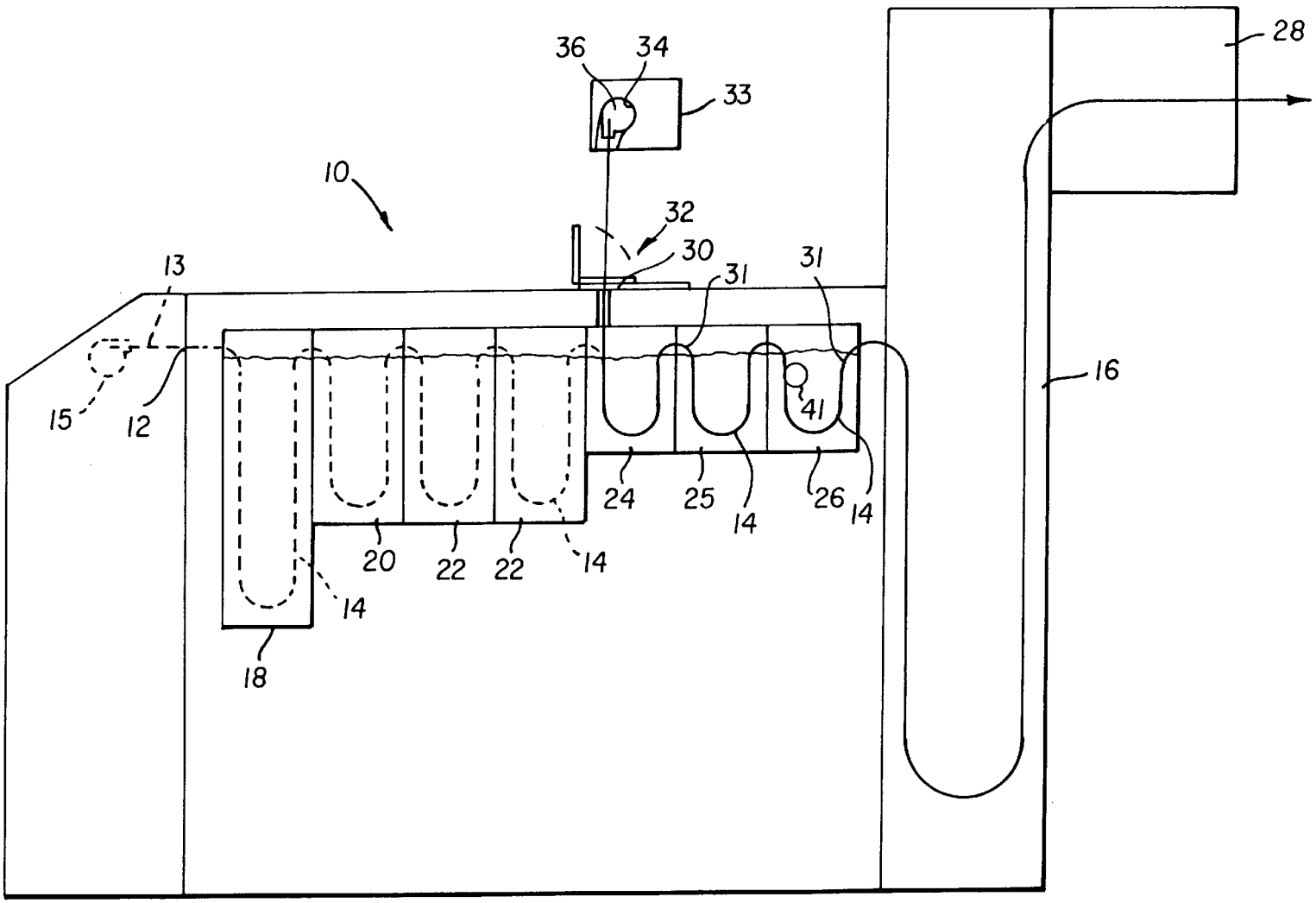
FIG. 1*a* is a schematic illustration of an apparatus made in accordance with the present invention illustrating first and second processing paths, the first path is designed for processing of an undeveloped exposed photosensitive material received from a first cassette and the second path is designed for reconditioning of a previously developed photosensitive material which is received from a second cassette.
Figure 1B:
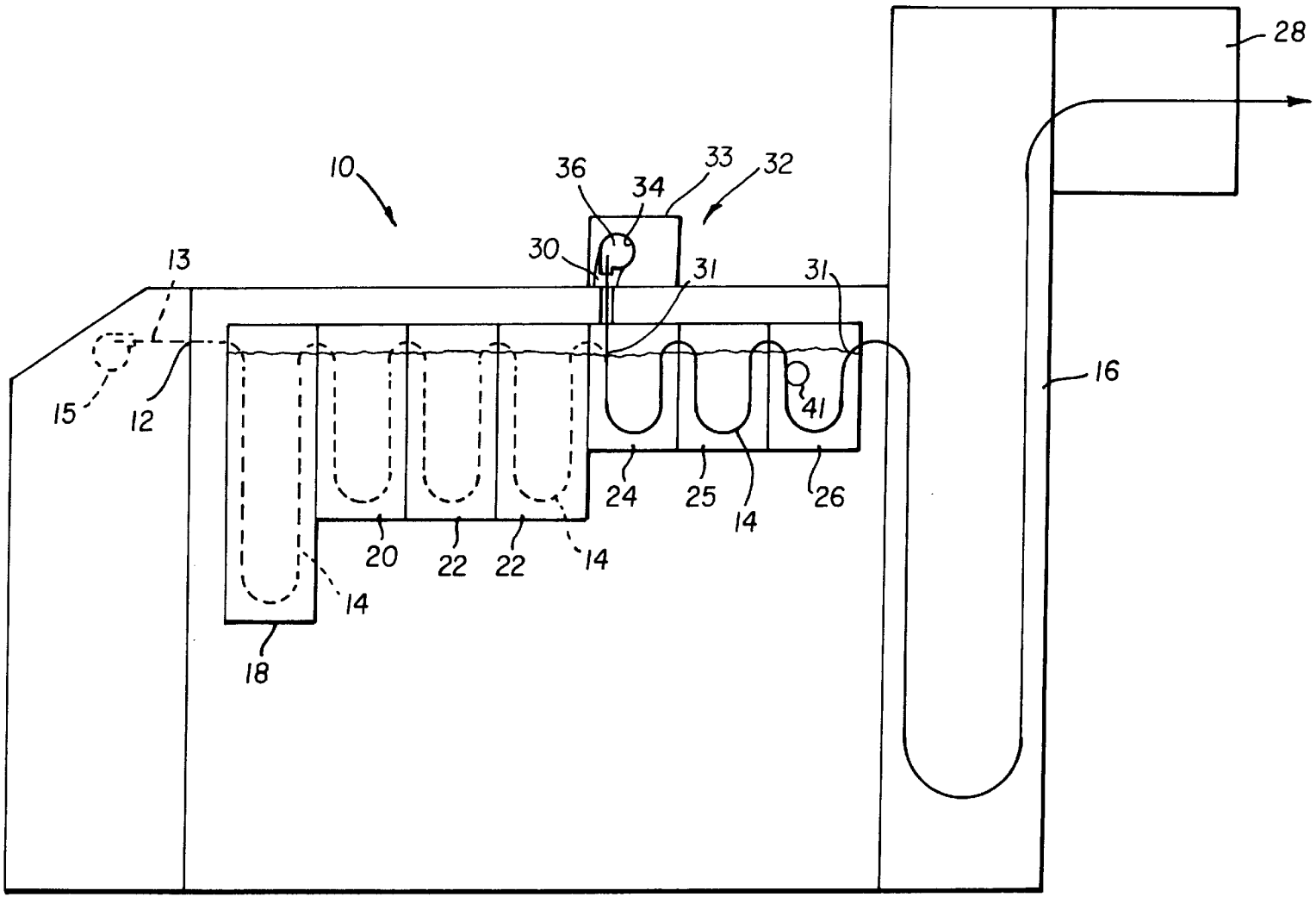
FIG. 1*b* is a view similar to FIG. 1*a* illustrating the second cassette engaged with the entry to the second processing path.

Referring to FIGS. 1*a* and 1*b*, there is illustrated an apparatus 10 made in accordance with the present invention. The apparatus 10 includes an inlet 12 for allowing entry of an undeveloped, exposed photosensitive material 13, such as photographic filmstrip from a cassette 15, to a first processing path 14. The processing path 14 allows the photosensitive material 13 to pass successively through various processing solutions for developing of the photosensitive material 13 and then on to dryer 16 where the photosensitive material 13 is dried. In the particular embodiment illustrated, the processing path 14 directs the photosensitive material to pass through a developing tank 18 having an appropriate developing solution, then through a bleach tank 20 and fix tanks 22, each having an appropriate processing solution therein, and then through a plurality of stabilizer/wash tanks 24,25,26, each having the appropriate processing solution (liquid) and then through dryer 16. In the particular embodiment illustrated, the apparatus 10 includes an optional digital scanner 28, such as CCD scanner, which scans the photosensitive material 13 and obtains a digital record of the images formed thereon which can then be passed onto a digital printer for printing of the image in accordance with customer instructions. Such scanners and printers are well known to those skilled in the art and any commercially available device may be used.

The apparatus 10 may be a stand alone apparatus, or may be incorporated into what is typically referred to as a "minilab," which also prints the developed image on the photosensitive material or other suitable print medium.

In the embodiment illustrated, the apparatus 10 includes a second inlet 30 for allowing a photosensitive material 13 to be passed into the processing path 14 at a point after the developing section so as to form a second processing path 31. In the preferred embodiment illustrated, inlet 30 directs the photosensitive material 13 into the first stabilizer/wash tank 24, thereby subjecting the photosensitive material 13 only to the washing section and drying section of the apparatus 10. The second processing path 31 is designed such that the photosensitive material 13 is reconditioned as is described later herein.

Figure 5:
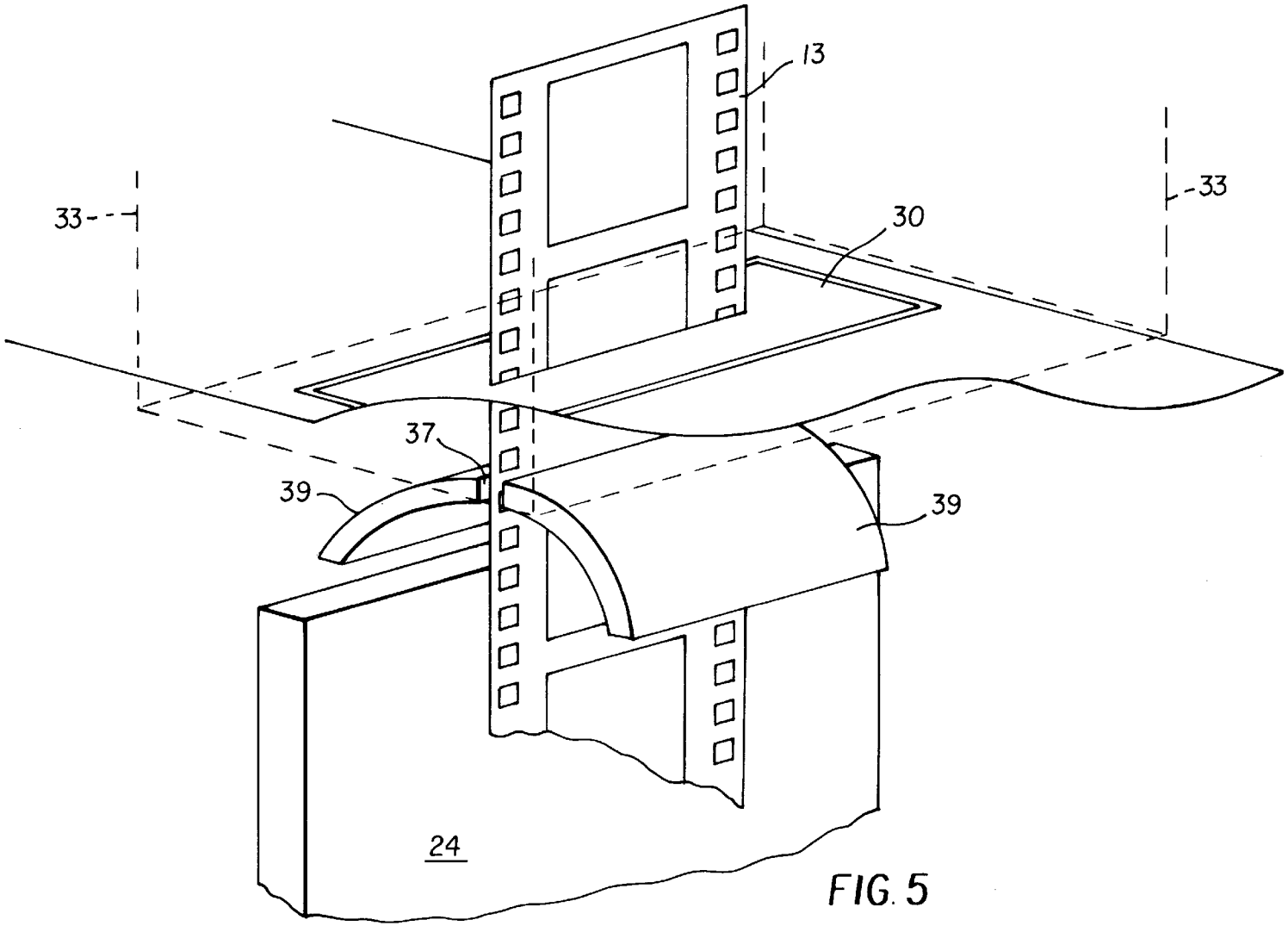
FIG. 5 is an enlarged perspective view of the entry slot and associated hardware for the second processing path of the apparatus of FIG. 1.

In the preferred embodiment as illustrated in FIGS. 1*a* and 1*b*, an appropriate mechanism 32 is provided for allowing the photosensitive material 13 to be fed into the apparatus 10 to the second processing path 31. In the particular embodiment illustrated, the mechanism 32 includes holder 33 having a receiving chamber 34 designed to receive a cartridge 36 having a previously developed photosensitive material wound therein. FIG. 1*a* illustrates the holder 33 just prior to engaging the apparatus 10 and FIG. 1*a* illustrated the holder in the engaged position with respect to apparatus 10. Typically the photosensitive material 13 is a photographic film which has been sent by a customer for reprinting. The photographic filmstrip has been previously developed, dried and stored for a period of time which can range from only a few days to a number of years. In the embodiment illustrated photosensitive filmstrip is of the type which can be thrust out of the cartridge 36. However, the present invention is not limited to any one format or type photosensitive material. Referring to FIG. 5, the holder 33 and inlet 30 are positioned such that the photosensitive material 13 is directed to second processing path 31 so that the photosensitive material is subjected to a liquid bath provided in the stabilizer/wash tanks. The photosensitive material passes through the drying cycle and then passed through a scanner, or sent to a printer (not shown), where the film may either be digitally printed, or optically printed, as desired. In the embodiment illustrated the inlet 30 is aligned with an opening 37 between guide members 39 which forms part of processing path 14. An appropriate motor (not shown) may be used for thrusting of the photosensitive material 13 out of the cartridge 36 and through the second processing path 31. Guide members 39 guide the photosensitive material from one processing tank to the next adjacent tank. Once the photosensitive material 13 enters the processing path 31, which is now co-extensive with path 14, the appropriate drive mechanism is used for driving of the photosensitive material 13 through path 14 and drives previously processed material 13 through the apparatus 10. For example, appropriate nip and drive rollers are provided as is typically done in the prior art drives for driving of the photosensitive material through the processing path. However, any desired mechanism may be used as desired for driving of the photosensitive material through the apparatus.

Figure 2:
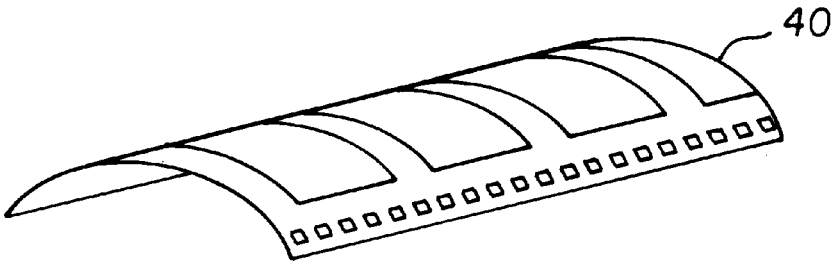
FIG. 2 is a perspective view of a previously developed photosensitive material having unacceptable warpage.
Figure 3:
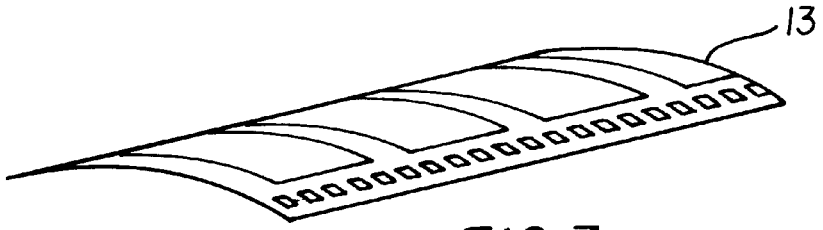
FIG. 3 illustrate a photosensitive material having acceptable warpage.
Figure 4A:
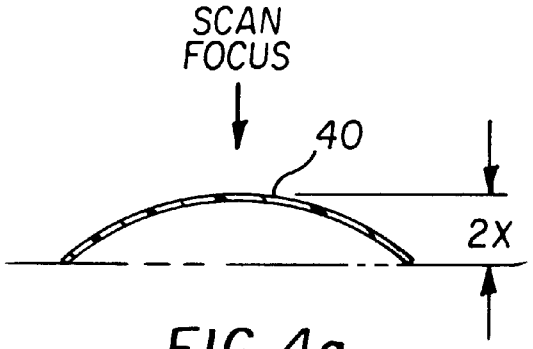
FIG. 4*a* is a cross-sectional view of the filmstrip of FIG. 2 illustrating an unacceptable degree of warpage.
Figure 4B:
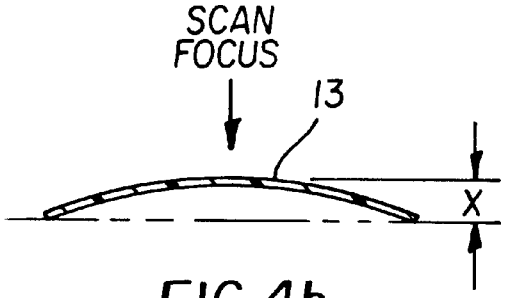
FIG. 4*b* is a cross-sectional view of the filmstrip of FIG. 3 illustrating a filmstrip within acceptable warpage tolerances.

Referring to FIG. 2 there is illustrated a previously developed photographic filmstrip 40 which have been stored for a period of time wherein contaminates and dust have build up on the surfaces thereof. In addition, the filmstrips have dried such that there is a substantial amount of curl imparted thereto. Referring to FIG. 4*a*, there is a cross-sectional view of the film 40 illustrating an unacceptable degree of warpage in the filmstrip, illustrated as "2x". Over time, due to drying out of the emulsion layer, the filmstrip warps to the configuration illustrated. This warpage can have a substantial effect on any scanning or optical printing that may occur on this previously processed filmstrip. By passing the filmstrip through a second processing path 31, in accordance with the present invention, the filmstrip will re-absorb moisture in the liquid provided in the stablilizer/washing tanks, and once having passed through the drier, will retain a new shape as illustrated in FIGS. 3 and 4*b*, whereby the warpage will be returned to an acceptable (nominal) level illustrated by "x", thus providing improved focusing in an optical printer or digital scanner. In addition, the washing of the photosensitive material allows dirt, dust, and other smudges and/or debris to be removed in a manner which does not adversely affect the surface of the photosensitive material. For example, this avoids the dry dusting of the photosensitive material or rubbing used to remove smudges or other material. The washing cycle on a typical processor allows washing solution to agitate washing solution against the photosensitive material so as to remove loose dust and debris. Additionally, if desired, a soft rotating brush 41 may be placed within at least one of the stabilizer/wash tanks 24, 25, 26 which comes in contact with the photosensitive material. The brush 41 is preferably submerged within the liquid bath and provides a gentle rubbing action to improve cleaning of the photosensitive material 13. The brush may rotate in the same or opposite direction of movement of the photosensitive material. Other types of cleaning devices may also be employed such as a wiper, squeegee, liquid spray bar, either in place of or in conjunction with the brush 41.

Thus, when the photosensitive material leaves the dryer, it is in a substantially improved condition than it was prior to running through the apparatus. By passing the photosensitive material through the wash cycle, it is restabilized, minimizing the degree of curl, and allows other contaminates to be removed in a quick, easy and efficient manner without subjecting the film to any adverse cleaning processes.

The invention has been described in detail with particular reference to certain preferred embodiments thereof, but it will be understood that variations and modifications can be effected within the scope of the invention.

PARTS LIST

10 Apparatus
12 Inlet

13 Photosensitive material
14 Processing path
15 Cassette
16 Dryer
18 Developing tank
20 Bleach fix tank
22 Bleach fix tank
24 Stabilizer/wash tank
25 Stabilizer/wash tank
26 Stabilizer/wash tank
28 Digital scanner
30 Inlet
31 Processing path
32 Mechanism
33 Holder
34 Receiving chamber
36 Cartridge
37 Opening
39 Guide member
40 Film
41 Bbrush

What is claimed is:

1. A method for conditioning a previously developed, dried and stored photosensitive material so as to improve the flatness of said photosensitive material prior to scanning of said previously developed photosensitive material, comprising the steps of:

a) subjecting the photosensitive material to a liquid bath; and b) scanning said photosensitive material shortly after passing said photosensitive material through said liquid bath so as to obtain a digital record of the images on said photosensitive material.

2. A method according to claim 1 wherein said liquid bath comprises a wash bath in photographic processing apparatus.

3. A method according to claim 1 further comprising the step of drying said photosensitive material after said photosensitive material has passed through said liquid bath and prior to said scanning.

4. A method according to claim 1 wherein said photosensitive material comprises a filmstrip.

5. A method according to claim 1 wherein said photosensitive material is subjected to a gentle rubbing and/or wiping action while submerged within said liquid bath.

6. A method according to claim 5 wherein a brush is used to provide the gentle rubbing and/or wiping action.

7. A method for reprinting a previously developed, dried, and stored photosensitive material, comprising the steps of:

a) subjecting the photosensitive material to a liquid bath; and b) passing said photosensitive material through a printer shortly after said photosensitive material has been subjected to said liquid bath for exposing the images from said photosensitive material on to a second photosensitive material.

8. A method according to claim 7 wherein said liquid bath comprises a stabilizer/wash bath of a photographic processor.

9. A method according to claim 7 wherein said photosensitive material is photographic film.

10. A method according to claim 7 further comprising the step of drying said photosensitive material after said photosensitive material has passed through said liquid bath and prior to said scanning.

11. A method according to claim 7 wherein said photosensitive material comprises a filmstrip.

12. An apparatus for developing images on a photosensitive material and dried and for conditioning of a previously developed and stored photosensitive material, said apparatus comprising:

a plurality of chemical baths for developing an exposed, undeveloped photosensitive material;

a first processing path through said chemical baths for developing said exposed undeveloped photosensitive material; and a second processing path through at least one of said chemical baths for conditioning said previously developed and stored photosensitive material.

13. An apparatus according to claim 12 wherein said second processing bath includes an inlet for passing said previously developed photosensitive material into said apparatus.

14. An apparatus according to claim 13 wherein said inlet includes a holder having a receiving chamber for holding a film cartridge containing said previously developed photosensitive material.

15. An apparatus according to claim 12 wherein said plurality of chemical baths comprises at least one development bath, at least one fix bath and at least one stabilizer/wash bath.

16. An apparatus according to claim 15 wherein said second processing path includes at least one wash bath.

17. An apparatus according to claim 12 wherein a rotatable brush is provided in said second processing path for cleaning of said previously developed photosensitive material.

18. An apparatus according to claim 12 wherein said photosensitive material comprises a photographic filmstrip.

19. An apparatus according to claim 12 further comprising a dryer for drying of said photosensitive material.

20. A method for conditioning a previously exposed, developed, dried, and stored photosensitive material in an apparatus having a plurality of chemical baths for developing an exposed, undeveloped photosensitive material, a first processing path through said chemical baths developing an exposed, undeveloped photosensitive material, and a second processing path through at least one of said chemical baths for conditioning said previously developed photosensitive material, said method comprising the step of:

a) passing said previously exposed and developed photosensitive material through said second processing path.

21. A method according to claim 20 further comprising the step of:

b. drying said previously exposed and developed photosensitive material after said photosensitive material after passing through said at least on chemical bath.

22. A method according to claim 20 wherein said photosensitive material comprises a filmstrip.

* * * * *